US006227947B1

(12) United States Patent
Hu et al.

(10) Patent No.: US 6,227,947 B1
(45) Date of Patent: May 8, 2001

(54) APPARATUS AND METHOD FOR CHEMICAL MECHANICAL POLISHING METAL ON A SEMICONDUCTOR WAFER

(75) Inventors: Tien-Chen Hu, Ping-Tung; Jih-Churng Twu, Chung Ho; Ying-Ho Chen, Taipei; Tsu Shih, Hsin-Chu, all of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/366,231

(22) Filed: Aug. 3, 1999

(51) Int. Cl.[7] ..... B24B 1/00
(52) U.S. Cl. ..... 451/56; 451/443; 451/444
(58) Field of Search ..... 451/41, 42, 56, 451/63, 285, 286, 287, 443, 444

(56) References Cited

U.S. PATENT DOCUMENTS 5,611,943 * 3/1997 Cadien et al. ..... 216/88
5,645,682 * 7/1997 Skrovan ..... 451/56
5,716,264 * 2/1998 Kimura et at. ..... 451/443
5,957,750 * 9/1999 Brunelli ..... 451/7
5,975,994 * 11/1999 Sandhu et al. ..... 451/56

* cited by examiner

*Primary Examiner*—Derris H. Banks
*Assistant Examiner*—David B Thomas
(74) *Attorney, Agent, or Firm*—Tung & Associates

(57) ABSTRACT

An apparatus and a method for chemical mechanical polishing a metal on a semiconductor wafer capable of achieving improved pad life are disclosed. In the apparatus, in addition to a first spray nozzle used for spraying a slurry solution onto the top of a polishing pad, a second spray nozzle is provided for mounting juxtaposed to a conditioning pad for dispensing a cleaning solution capable of dissolving polishing debris formed on the polishing pad surface. The apparatus may further include at least one cleaning solution reservoir for storing and delivering a cleaning solution to the second spray nozzle. The method can be advantageously carried out in two-steps during which a first cleaning solution is sprayed onto the pad surface for dissolving the polishing debris, and then a second cleaning solution is sprayed onto the pad surface for removing or flushing away the dissolved debris. In one illustration for the removal of oxides of copper, an acid-containing or ammonium hydroxide-containing cleaning solution is used advantageously to dissolve the oxides, and then deionized water is used to remove the dissolved debris from the pad surface.

20 Claims, 4 Drawing Sheets

APPARATUS AND METHOD FOR CHEMICAL MECHANICAL POLISHING METAL ON A SEMICONDUCTOR WAFER

FIELD OF THE INVENTION

The present invention generally relates to an apparatus and a method for chemical mechanical polishing a semiconductor wafer and more particularly, relates to an apparatus and a method for chemical mechanical polishing a semiconductor wafer with extended polishing pad life by utilizing a second spray nozzle mounted juxtaposed to a conditioning pad for dispensing a first cleaning solution to substantially dissolve polishing debris during a pad conditioning process and then removing the dissolved debris by a second cleaning solution in a subsequent step.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material.

An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. No. 4, 141180 to Gill, Jr., et al.; U.S. Pat. No. 5,205,082 to Shendon et al; and, U.S. Pat. No. 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

In the improved CMP head 20 shown in FIG. 1C, large variations in the removal rate, or polishing rate, across the whole wafer area are frequently observed. A thickness variation across the wafer is therefore produced as a mean cause for wafer non-uniformity. The improved CMP head design, even though utilizing a pneumatic system to force a wafer surface onto a polishing pad, the pneumatic system cannot selectively apply different pressure at different locations on the surface of the wafer. For instance, as shown in FIG. 1D, a profilometer data obtained on an 8-inch wafer is shown. The thickness difference between the highest point on the wafer and the lowest point on the wafer is almost 2,000 Å yielding a standard deviation of 472 Å, or 6.26%. The curve shown in FIG. 1D is plotted with the removal rates in the vertical axis and the distance from the center of the wafer in the horizontal axis. It is seen that the removal rates at the edges of the wafer are substantially higher than the removal rate at or near the center of the wafer. The thickness uniformity on the resulting wafer after the CMP process is therefore very poor.

The polishing pad 12 is a consumable item used in a semiconductor wafer fabrication process. For instance, under normal wafer fab conditions, the polishing pad must be replaced after a usage of between 12 and 18 hours. Polishing pads may be hard, incompressible pads or soft pads. For oxide polishing, hard, incompressible and thus stiffer pads are generally used to achieve planarity. Softer pads are frequently used to achieve improved uniformity and smooth surfaces. The hard pads and the soft pads may also be combined in an arrangement of stacked pads for customized applications.

A problem frequently encountered in using polishing pads in a CMP process for oxide planarization is the rapid deterioration in polishing rates of the oxide with successive wafers. The cause for the deterioration has been shown to be due to an effect known as "pad glazing" wherein the surface of the polishing pads become smooth such that the pads can no longer hold slurry in-between the fibers. This has been found to be a physical phenomenon on the surface, and is not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, reopen the pores, and thus forms micro scratches in the surface of the pad for improved life time of the pad surface. The pad conditioning process can be carried out either during a polishing process, i.e., known as concurrent conditioning, or after a polishing process.

While the pad conditioning process improves pad consistency and its lifetime, conventional apparatus of a conditioning disk is frequently not effective in conditioning a pad surface. For instance, a conventional conditioning disk for use in pad conditioning is shown in FIGS. 2A and 2B. The conditioning disk 30 is formed by embedding or encapsulating diamond particles 32 in nickel 34 coated on the surface 36 of a rigid substrate 38. FIG. 2A is a cross-sectional view of a new conditioning disk with all the diamond particles 32, 42 embedded in nickel 34. After repeated usage as a conditioning disk, the cross-sectional view of the disk 30 is shown in FIG. 2B which shows that diamond particle 42 has been lost and the top surfaces of the remaining particles 32 are flattened. The loss of diamond particle from nickel encapsulation 34 occurs frequently when the particle is not deeply embedded in the nickel metal 34. In the fabrication of the diamond particle conditioning disk 30, a nickel encapsulation 34 is first mixed with a diamond grit which included the diamond particles 32, 42 and applied to the rigid substrate 38. The bonding of the diamond particles 32, 42 is frequently insecure and thus the particles are easily lost from the nickel coating during usage. The diamond particle 42 which is lost from the nickel encapsulation 34 may be trapped between the surfaces of the polishing pad and the wafer and causes severe scratches on the wafer. Another drawback for the diamond conditioning disk is that the pad conditioning efficiency decreases through successive usage of the disk since the top surfaces of the diamond particles are flattened after repeated usage when the diamond grit mechanically abrades the pad surface.

FIG. 3 is a graph illustrating the dependence of the removal rate on the pad disk life for a polishing pad conditioned by a conventional diamond grit conditioning disk. Four different polishing heads were measured for their removal rates which are indicated as h1, h2, h3 and h4. The removal rate is expressed in the thickness of the oxide layer removed in units of Å per minute, while the pad life is expressed in the number of wafers polished. It is seen from FIG. 3 that when a new conditioning disk is used, the removal rate of the polishing pad is at about 4100 Å/min. The removal rate gradually deteriorates after a large number of wafers are polished while being conditioned by a diamond grit conditioning disk. The removal rate deteriorates to as low as 2700 Å/min, at which time a new polishing pad is used which improves the removal rate to about 3800 Å/min. However, the improved removal rate quickly deteriorates to an almost constant level of about 3300 Å/min. This level of removal rate is kept even after a second polishing pad is replaced. The ineffectiveness of the conditioning disk with a diamond grit is therefore evident from data shown in FIG. 3. The repeated use of a conditioning disk formed of a diamond grit loses its effectiveness after successive usage on more than 300 wafers. The replacement of new polishing pads does not improve the removal rate when the same conditioning disk is used due to the pad glazing effect.

The mechanism for chemical mechanical polishing of metal is different and more complex than the polishing of silicon oxide. It is generally believed that during the CMP of metal, metal forms an oxide layer on the surface which is subsequently removed by the polishing pad by a mechanism similar to that for oxide polishing. For instance, a mechanism that involves hydroxylation, bond formation with slurry and then, bond breaking from wafer. After the metal oxide layer is removed from the metal surface, metal is etched by the chemicals in the slurry solution, while simultaneously the exposed metal forms a new passivation layer through oxidation by the slurry solution. In practice, it is believed that three separate processes of the removal of metal oxide, the metal etching and the metal passivation occur simultaneously. A polishing slurry solution for a metal CMP therefore contains different components of fine slurry particles, i.e., a corrosion or etchant agent and an oxidant. The eventual planarization of the metal surface is achieved by the rigidity and planarity of the polishing pad similar to a process of oxide polishing.

When the metal being polished in the CMP process is copper, the polishing process becomes more complicated due to the characteristics of copper. Since copper is frequently used in multi-level interconnect structures in semiconductor devices, i.e., in damascene or dual damascene structures, a CMP step for forming copper interconnects in the damascene structures which produces satisfactory polishing uniformity becomes an important link in the entire fabrication process.

In a co-pending application, Ser. No. 09/368,294 which was assigned to the common Assignee of the present application and which is incorporated hereby by reference in its entirety, the effects of surface chemistry of a copper conductor during a chemical mechanical polishing process are shown.

Referring now to FIG. 4, wherein a graph illustrating the surface chemistry of a cooper conductor during a chemical mechanical polishing process, specifically, the dependency of the formation of cuprous oxides on the acidity or alkalinity of the slurry solution is shown. For instance, when the slurry solution is most acidic, i.e., having a pH between about 1 and 2, no cuprous oxide is formed on the surface of the copper. When the acidity of the slurry solution is increased to approximately a pH of 3, a layer of $Cu_2O$ is formed on the copper surface while a layer of CuO is formed on the $Cu_2O$ layer. When the acidity of the slurry solution is further decreased to a pH value between about 4 and about 6, cubic structured $Cu_2O$ is produced on the surface of the copper while CuO is produced on the surface of the cubic $Cu_2O$. At still lower acidity, at a pH value between about 7 and about 9, similar layers of $Cu_2O$ and CuO are produced on the surface of the copper conductors.

The graph shown in FIG. 4 therefore supports the present invention novel method in that a basic-type slurry solution is more effective in forming oxidation layers of copper on the surface of the copper conductors and thus facilitates the removal of cuprous oxides from the surface and achieving the copper removal objective.

In recent years, the copper CMP process has become an important process step in the fabrication of multi-level interconnects by the damascene structure. One major obstacle associated with the formation of the copper damascene is the CMP planarization process. During CMP, the process stability from wafer-to-wafer plays an important role in producing reliable damascene structures. The process stability in turn is determined by the effectiveness of the conditioning pad in conditioning the polishing pads.

It is therefore an object of the present invention to provide an apparatus for chemical mechanical polishing a semiconductor wafer that does not have the drawbacks or shortcomings of the conventional CMP apparatus.

It is another object of the present invention to provide an apparatus for chemical mechanical polishing a semiconductor wafer that has extended polishing pad life.

It is a further object of the present invention to provide an apparatus for chemical mechanical polishing a semiconductor wafer with extended pad life which includes a cleaning solution dispenser mounted on the conditioner arm such that a cleaning solution may be delivered to the conditioning pad.

It is another further object of the present invention to provide an apparatus for chemical mechanical polishing a semiconductor wafer with extended pad life by utilizing a first spray nozzle for dispensing a slurry solution and a second spray nozzle mounted juxtaposed to a conditioning pad for dispensing a cleaning solution capable of dissolving polishing debris on the polishing pad surface.

It is still another object of the present invention to provide an apparatus for chemical mechanical polishing a semiconductor wafer with extended pad life by utilizing a cleaning solution dispenser on the conditioning pad such that the pad glazing problem on the polishing pad can be substantially eliminated.

It is yet another object of the present invention to provide a method for chemical mechanical polishing a semiconductor wafer that has extended polishing pad life by utilizing a two-step cleaning process for the polishing pad.

It is still another further object of the present invention to provide a method for chemical mechanical polishing copper on a semiconductor wafer with extended pad life by a two-step cleaning method for dissolving oxides of copper formed on the polishing pad.

It is yet another further object of the present invention to provide a method for chemical mechanical polishing copper conductors on a semiconductor wafer with extended pad life by utilizing a first cleaning solution to dissolve polishing debris of copper oxides on the pad surface and then a second cleaning solution for removing the dissolved debris from the pad surface.

SUMMARY OF THE INVENTION

In accordance with the present invention, an apparatus and a method for chemical mechanical polishing copper conductors on a semiconductor wafer with extended pad lifetime are provided.

In a preferred embodiment, an apparatus for chemical mechanical polishing a semiconductor wafer with extended pad life is provided which includes a rotatable platen that has a polishing pad mounted on top, a first spray nozzle situated over the polishing pad for dispensing a slurry solution onto the polishing pad, a wafer holder for holding a wafer therein and for pressing an active surface of the wafer onto the polishing pad, a conditioner arm for holding a conditioning pad therein for removing a polishing debris from a top surface of the polishing pad, and a second spray nozzle mounted juxtaposed to the conditioning pad for dispensing a solution to substantially dissolve the polishing debris during a pad conditioning process.

In the apparatus for chemical mechanical polishing a semiconductor wafer with extended pad life, the second spray nozzle may be mounted on the conditioner arm adjacent to the conditioning pad. The apparatus may further include at least one solution reservoir for supplying a cleaning solution to the second spray nozzle, or at least two solution reservoirs for sequentially supplying at least two cleaning solutions to the second spray nozzle. The apparatus may further include a reservoir for cleaning solution and a reservoir for deionized water for sequentially feeding a cleaning solution and deionized water through the second spray nozzle. The method may further include a conduit for feeding a cleaning solution to the second spray nozzle. The polishing debris may be a metal-containing compound, or a copper-containing compound. The polishing debris may be a metal oxide and the solution may be an acid-containing solution.

The present invention is further directed to a two-step method for cleaning a polishing pad in a chemical mechanical polishing apparatus which can be carried out by the operating steps of first mounting a cleaning solution spray nozzle juxtaposed to a conditioning pad, dispensing a first cleaning solution from the spray nozzle onto a rotating polishing pad, intimately contacting the conditioning pad with a rotating polishing pad until polishing debris on the polishing pad is substantially dissolved by the first cleaning solution, and dispensing a second cleaning solution from the spray nozzle onto the rotating polishing pad until the dissolved polishing debris is substantially removed.

The two-step method for cleaning a polishing pad in a chemical mechanical polishing apparatus may further include the step of dispensing a first cleaning solution of an acid-containing solution and a second cleaning solution of deionized water. The method may further include the step of dissolving and removing a polishing debris containing at least one oxide selected from the group consisting of cuprous oxide and cupric oxide. The method may further include the step of dispensing a second cleaning solution from the spray nozzle to neutralize the first cleaning solution, or the step of dispensing a second cleaning solution at a higher flow rate than a rate the first cleaning solution was dispensed. The method may further include the step of dispensing the first cleaning solution at a flow rate of at least 200 ml/min. The method may further include the step of mounting the cleaning solution spray nozzle on a conditioner arm adjacent to the conditioning pad.

In another preferred embodiment, an apparatus for chemical mechanical polishing copper on a semiconductor wafer and for removing polishing debris from the wafer is provided which includes a rotating platen having a polishing pad mounted on top, a first liquid dispenser mounted over the polishing pad for dispensing a slurry solution on the polishing pad, a wafer holder for holding a wafer and for pressing an active surface thereof onto the polishing pad, a conditioning pad for intimately engaging the polishing pad, a second liquid dispenser mounted juxtaposed to the conditioning pad for dispensing sequentially at least two different cleaning solutions onto the polishing pad, and at least two cleaning solution reservoirs for storing at least two different cleaning solutions for feeding to the second liquid dispenser.

In the apparatus for chemical mechanical polishing copper on a semiconductor wafer and for removing polishing debris from the wafer, the at least two different cleaning solutions may include an acid-containing solution, an ammonium hydroxide-containing solution and deionized water. The second liquid dispenser may be mounted on a conditioner and onto which a conditioning pad is mounted. The apparatus may further include at least one conduit for feeding the at least two different cleaning solutions from the at least two cleaning solution reservoirs to the second liquid dispenser. The at least two cleaning solutions remove polishing debris of copper oxides from a surface of the polishing pad. The copper oxides may be cuprous oxide or cupric oxide. The apparatus may further include a three-way valve and a pump for selecting and pumping one of the at least two cleaning solutions to the second liquid dispenser.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus for chemical mechanical polishing a semiconductor wafer that has extended polishing pad lifetime. In the apparatus, in addition to a first spray nozzle utilized for dispensing a slurry solution onto a polishing pad, a second spray nozzle or a liquid dispenser is added to the conditioner arm such that cleaning solutions may be dispensed during the pad conditioning process for dissolving polishing debris on the surface of the polishing pad and for removing dissolved debris from the pad surface. The second spray nozzle, or the second liquid dispenser can be used to dispense at least one cleaning solution, and more suitably, to dispense two different cleaning solutions. For instance, a first cleaning solution may be an acid-containing solution that is used to dissolve metal oxides that have formed on top of the polishing pad, while the second cleaning solution may be deionized water for flushing away or otherwise removing the dissolved debris from the pad surface. The second cleaning solution of deionized water is normally applied at a higher flow rate than the first cleaning solution of the acid-containing chemical. It should be noted that, while the removal of oxides of copper is specifically given as an example in the present application, the novel apparatus can be used for removing any chemical substances from the surface of a polishing pad by suitably selecting the cleaning solution.

The present invention further provides a method for chemical mechanical polishing a semiconductor wafer with improved polishing pad life by utilizing a two-step cleaning process for removing polishing debris from the pad surface. In the first step of the two-step cleaning method, a cleaning solution such as an acid-containing chemical is first sprayed onto the polishing pad during a pad conditioning process for dissolving polishing debris formed on the pad surface. A second cleaning solution, such as deionized water is then sprayed onto the pad surface to substantially remove, or flush away the dissolved debris. The present invention novel method can therefore be effectively used to eliminate the pad glazing problem frequently encountered in chemical mechanical polishing processes. By utilizing the present invention novel two-step cleaning method, the lifetime of a polishing pad can be greatly extended and furthermore, the process stability between wafer-to-wafer and the process reliability can be greatly improved. A cost reduction can also be achieved by extending the lifetime of the pad.

Figure 1A:
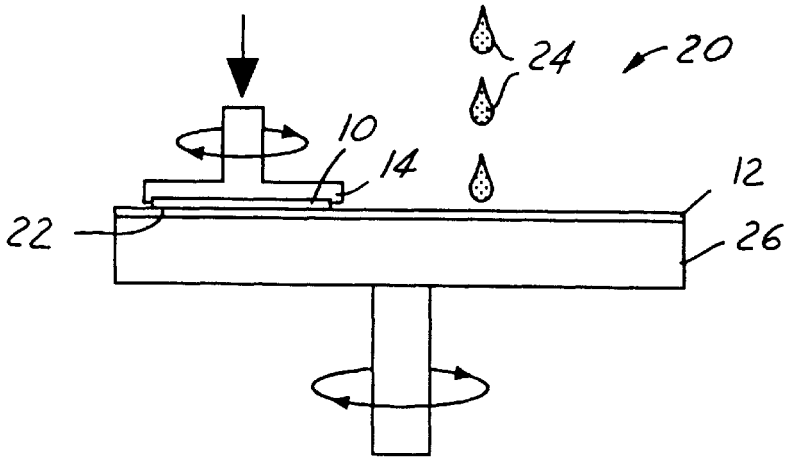
FIG. 1A is a cross-sectional view of a conventional chemical mechanical polishing apparatus.
Figure 1B:
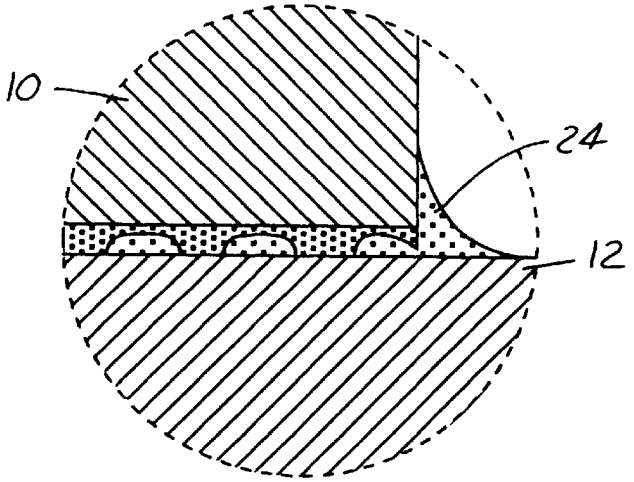
(PRIOR ART) FIG. 1B
FIG. 1B is a partial, enlarged cross-sectional view of FIG. 1A showing the interaction of slurry between the wafer and the polishing pad.
Figure 1C:
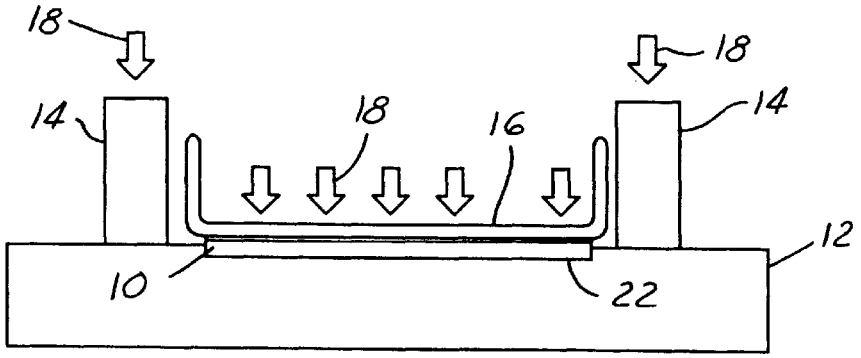
FIG. 1C is a cross-sectional view illustrating a polishing head utilizing a membrane pressurizing device.
Figure 1D:
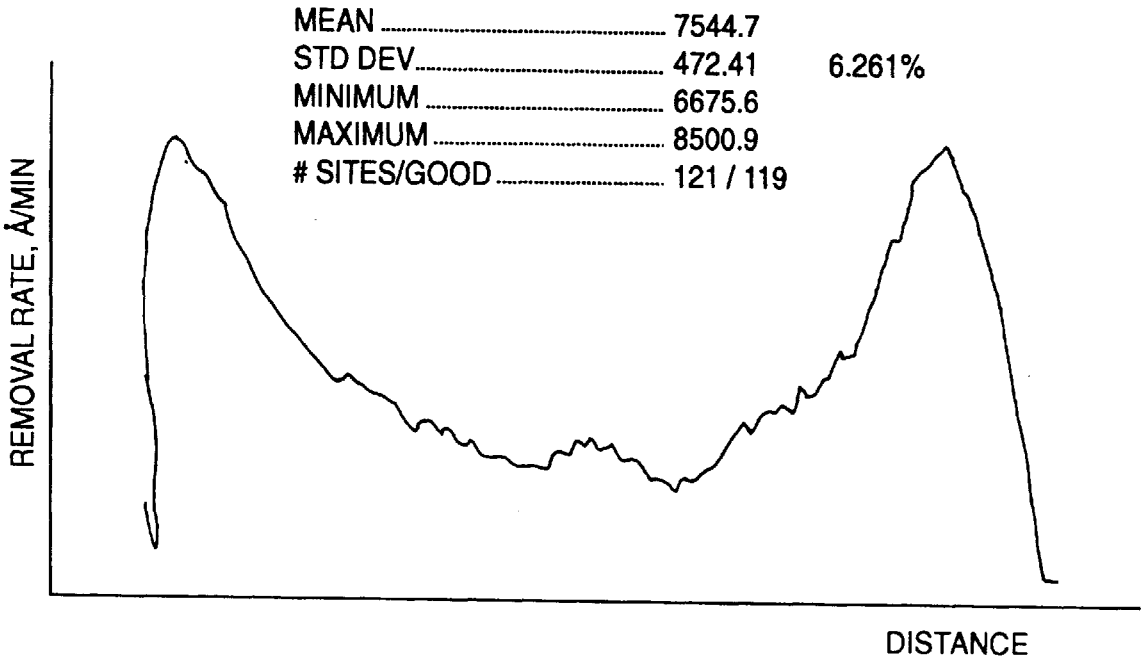
(PRIOR ART) FIG. 1D
FIG. 1D is a graph illustrating data obtained by using a conventional polishing pad showing the dependency of removal rates at different locations on a wafer surface.
Figure 2A:
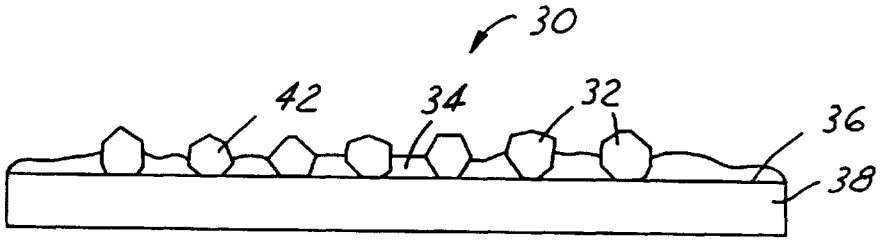
(PRIOR ART) FIG. 2A
FIG. 2A is a cross-sectional view of a conventional conditioning disc for use in polishing pad conditioning.
Figure 2B:
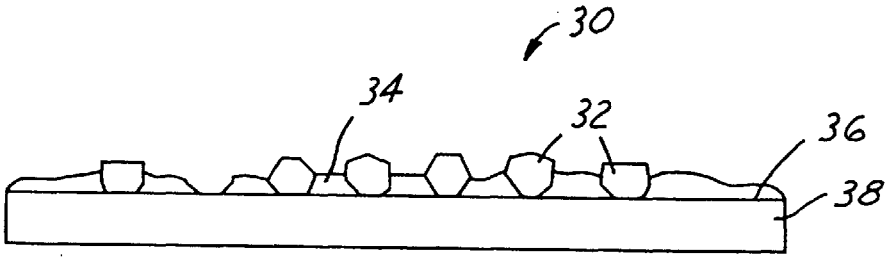
(PRIOR ART) FIG. 2B
FIG. 2B is a cross-sectional view of the conventional conditioning disc of FIG. 2A with a diamond particle missing from the pad surface.
Figure 3:
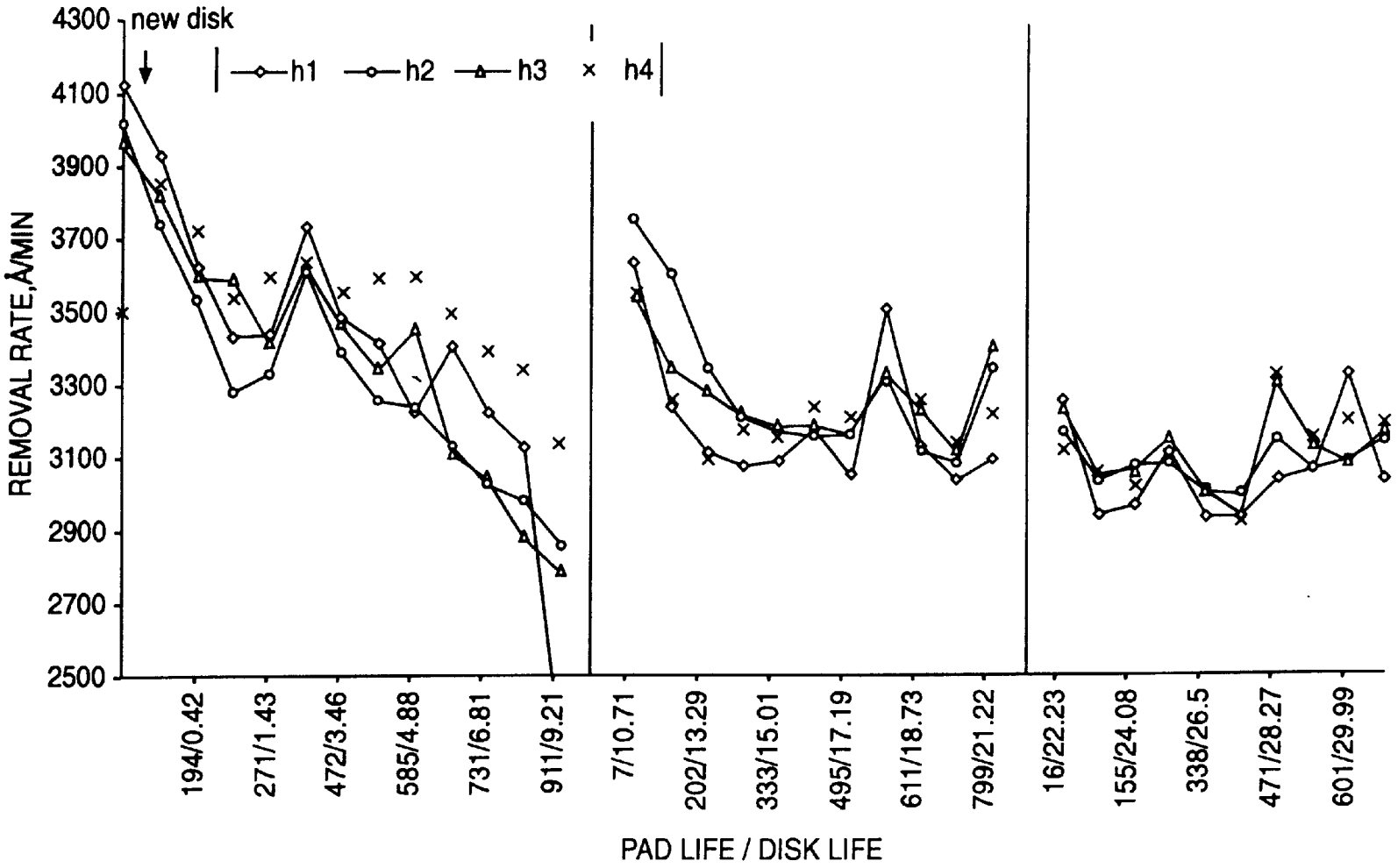
FIG. 3 is a graph illustrating the dependency of the removal rates on the pad disc life for a polishing pad conditioned by a conventional diamond grit conditioning disc.
Figure 4:
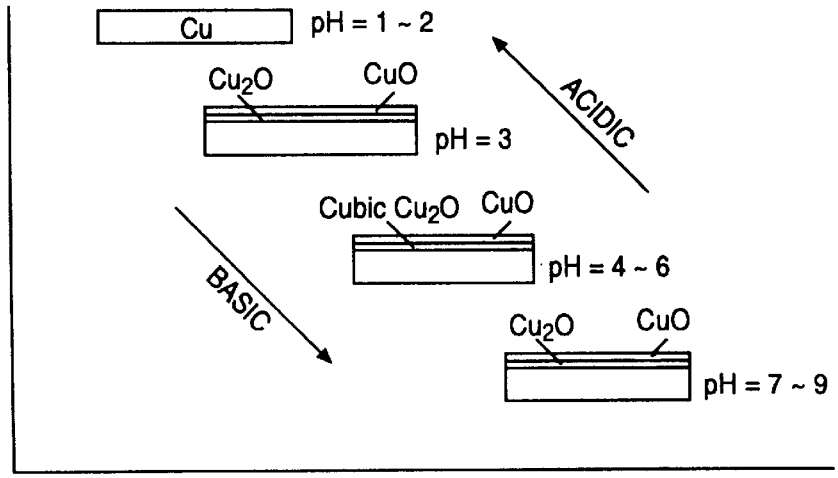
FIG. 4 is a graph illustrating the surface chemistry of a copper conductor during a chemical mechanical polishing process showing the dependency of the formation of cuprous oxides on the acidity of the slurry solution.
Figure 5:
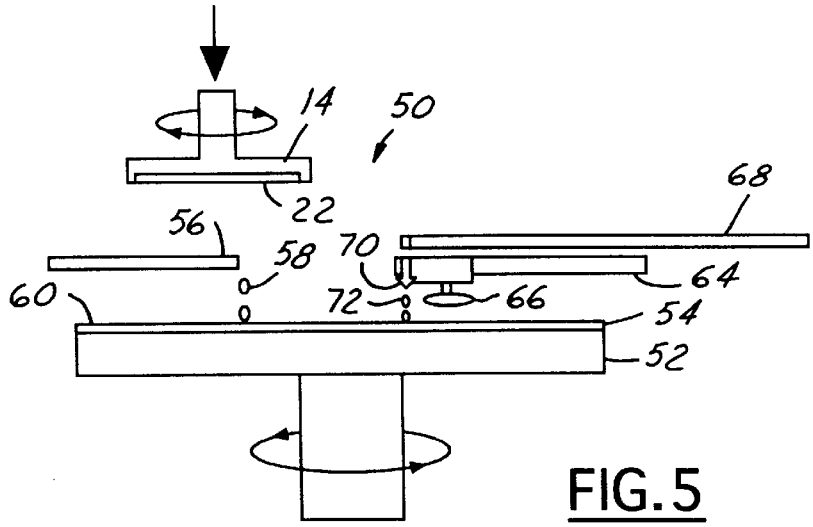
FIG. 5 is a side view of the present invention apparatus showing the second liquid dispenser mounted to the conditioner arm.

Referring now to FIG. 5, wherein a side view of a present invention apparatus 50 is shown. The apparatus 50 includes a rotatable platen 52 which has a polishing pad 54 mounted on top, a first spray nozzle 56 positioned over the polishing pad 54 for dispensing a slurry solution 58 onto a top surface 60 of the polishing pad 54. A wafer holder (not shown) holds a wafer for pressing an active surface of the wafer onto the polishing pad surface 60. A conditioner arm 64 is further provided and positioned over the polishing pad 54 for holding a conditioning pad 66 therein and for removing polishing debris (not shown) from the top surface 60 of the polishing head 54. A second spray nozzle 70, or a second liquid dispenser, is mounted juxtaposed to the conditioning pad 66 on the conditioner arm 64 for dispensing a cleaning solution 72 to substantially dissolve the polishing debris (not shown) during a pad conditioning process.

During the pad conditioning process, the wafer holder is moved away from the polishing pad except when the conditioning process is conducted in-situ with the polishing process. The polishing pad 54 is rotated by the platen 52 at a preset rotational speed while the conditioning pad 66 is pressed under pressure onto and against the top surface 60 of the polishing pad 54 by the conditioner arm 64. The conditioner arm 64 moves in a linear traversing direction across the top surface 60 of the polishing pad 54 such that the entire area of the polishing pad can be covered and conditioned. The conditioning pad 66 rotates in a direction that is the opposite of the rotational direction of the polishing pad 54 so that the conditioning process can be effectively carried out.

Figure 6:
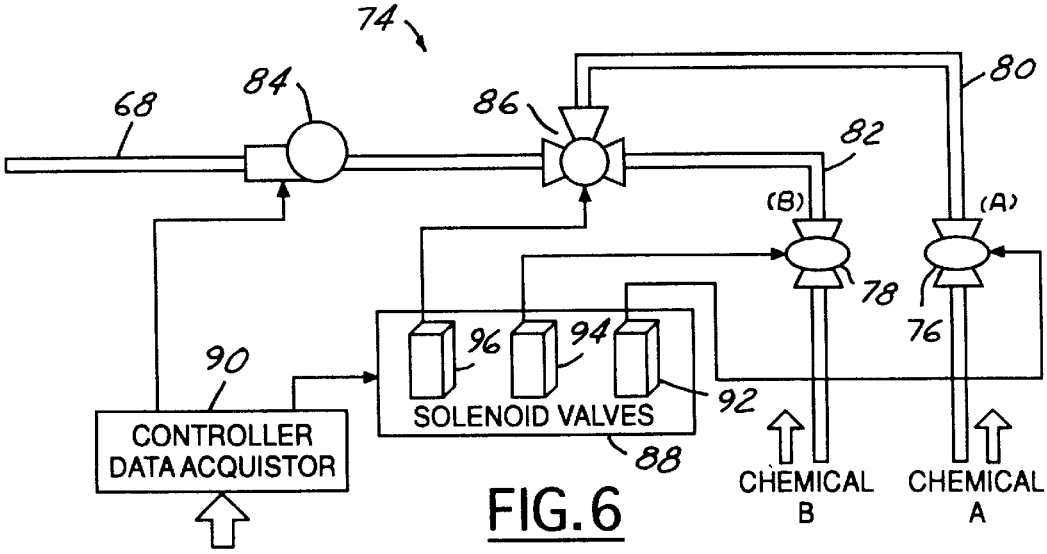
FIG. 6 is a graph illustrating a flow control system for the present invention apparatus wherein two cleaning solutions are fed to the second liquid dispenser of FIG. 5.

The second spray nozzle 70, or the second liquid dispenser can be used in the present invention novel method to dispense at least one, and preferably two different cleaning solutions sequentially. A flow control system 74 for the present invention novel apparatus is shown in FIG. 6. The flow control system 74 includes a flow control capacity of two different cleaning solutions of chemical A and chemical B. As shown in FIG. 6, chemicals A and B can be fed through air actuated valves 76, 78 for opening or closing the passageways for the two different chemicals. The chemicals are fed through conduits 80, 82 to a three-way valve 86. The cleaning liquid is then pumped to conduit 68 for feeding through the second spray nozzle 70 by pump 84.

The opening/closing of the flow control system 74, shown in FIG. 6, is monitored and controlled by as a mini-processor, or controller 90 and a series of solenoid valves 88. Each of the series of solenoid valves 88, i.e., valves 92, 94 and 96 is used to control each of the flow control valves 76, 78 and 86, respectively. The controller 90 further interfaces with pump 84 such that the opening/closing of the valves can be synchronized with the turn on/turn off of the pump 84.

The present invention novel method for chemical mechanical polishing a metal on a semiconductor wafer can be illustrated as follows. After a wafer polishing process is completed, chemical A, such as an acid-containing solution that is a solvent for the metal oxide (i.e., cuprous oxide) formed on the polishing pad surface is first fed through the flow control system 74. When the polishing debris to be removed from the surface of a polishing pad is cuprous oxide or cupric oxide, an acid-containing solution or an ammonium hydroxide-containing solution is used as chemical A. To activate the spraying process of chemical A in the present invention novel apparatus 50, air actuated flow control valve 76 is first opened such that chemical A can be fed through conduit 80. The three way flow control valve 86 is turned on simultaneously to allow the passage of chemical A through valve 86. The opening of valve 76 is controlled by the solenoid valve 92 and in turn, by the controller 90 which also sends a signal to pump 84 to start pumping chemical A through conduit 68 for dispensing through the second spray nozzle 70 onto the polishing pad surface. When the removal of copper oxides is desired, it has been found that a suitable flow rate for chemical A (i.e., a diluted acid or ammonium hydroxide solution) is larger than 200 ml/min. Simultaneously with the spray of chemical A on the top surface 60 of the polishing pad 54, the conditioning pad is activated to rotate against and scrub the polishing pad during the pad conditioning process for removing the polishing debris. The process can be conducted for a suitable time period such as several minutes.

After the first step of the cleaning process is completed, chemical B is sprayed onto the top of the polishing pad 54 for removing the dissolved debris from the pad surface. To accomplish this task, valve 76 is first turned off such that the supply of chemical A is shut off from the system 74. The valve 78 is subsequently turned on for feeding chemical B through conduit 82 and the three way valve 86. The opening of the valve 78 and the three way valve 86 are controlled by the solenoid valves 94 and 96, respectively, and in turn by controller 90. The pump 84 is then turned on by the controller 90 for feeding chemical B through conduit 68 and the second spray nozzle 70 onto the top surface 60 of the polishing pad 54. When the cleaning of copper oxides is desired, chemical B can be suitably deionized water flown at a higher flow rate than that of chemical A. The major function of the deionized water is to neutralize the acid-containing chemical A and furthermore, to flush away or remove dissolved polishing debris from the pad surface 60. To effect a complete removal of the debris from the pad surface 60, a higher liquid flow rate is desirable. During the cleaning process by chemical B, the operation of the conditioning pad 66 is continued for cleaning the polishing pad 54.

At the end of the present invention novel two-step cleaning process, valve 78 is turned off to shut off chemical B from the system 74. Subsequently, three way valve 86 and pump 84 are turned off. The conditioner arm 64 is then returned to a clean disc stage.

It should be noted that, while the use of an acid-containing cleaning solution chemical A and deionized water as chemical B are illustrated in a cleaning process for copper oxides, the present invention novel method and apparatus in no way is limited to only such cleaning process. Depending on the type of polishing debris to be removed, i.e., to be dissolved and flushed away, any suitable cleaning solutions may be utilized in the present invention novel apparatus and method. Furthermore, while the use of a single spray nozzle mounted on the conditioner arm is illustrated, the present invention novel method and apparatus is not limited to the use of a single spray nozzle. Multiple number of nozzles may be advantageously used if necessary to more uniformly distribute the cleaning solution onto the top of a polishing pad and the conditioning pad.

The present invention novel method and apparatus for chemical mechanical polishing a metal on a semiconductor wafer capable of achieving extended polishing pad life has therefore been amply described in the above descriptions and in the appended drawings of FIGS. 5 and 6.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for chemical mechanical polishing a semiconductor wafer with extended polishing pad life comprising:

a rotatable platen having a polishing pad mounted on top, a first spray nozzle situated over said polishing pad for dispensing a slurry solution onto a top surface of said polishing pad, a wafer holder for holding a wafer therein and for pressing an active surface of said wafer against said top surface of said polishing pad, a conditioner arm for holding a conditioning pad therein for removing a polishing debris from said top surface of said polishing pad, a solution for substantially dissolving said polishing debris, and a second spray nozzle mounted juxtaposed to said conditioning pad for dispensing said solution during a pad conditioning process.

2. An apparatus for chemical mechanical polishing a semiconductor wafer with extended pad life according to claim 1, wherein said second spray nozzle is mounted on said conditioner arm adjacent to said conditioner pad.

3. An apparatus for chemical mechanical polishing a semiconductor wafer with extended pad life according to claim 1 further comprising at least one solution reservoir for supplying a cleaning solution to said second spray nozzle.

4. An apparatus for chemical mechanical polishing a semiconductor wafer with extended pad life according to claim 1 further comprising at least two solution reservoirs for sequentially supplying at least two cleaning solutions to said second spray nozzle.

5. An apparatus for chemical mechanical polishing a semiconductor wafer with extended pad life according to claim 1 further comprising a reservoir for cleaning solution and a reservoir for deionized water for sequentially feeding said cleaning solution and said deionized water through said second spray nozzle.

6. An apparatus for chemical mechanical polishing a semiconductor wafer with extended pad life according to claim 1 further comprising a conduit for feeding a cleaning solution to said second spray nozzle.

7. An apparatus for chemical mechanical polishing a semiconductor wafer with extended pad life according to claim 1, wherein said cleaning solution comprises an acid-containing solution.

8. A two-step method for cleaning a polishing pad in a chemical mechanical polishing apparatus comprising the steps of:

mounting a cleaning solution spray nozzle juxtaposed to a conditioning pad, dispensing a first cleaning solution from said spray nozzle onto a top surface of a rotating polishing pad, intimately contacting said conditioning pad with said top surface of the rotating polishing pad and substantially dissolving a polishing debris on said top surface of the polishing pad by said first cleaning solution, and dispensing a second cleaning solution from said spray nozzle onto said top surface of the rotating polishing pad until said dissolved polishing debris is substantially removed.

9. A two-step method for cleaning a polishing pad in a chemical mechanical polishing apparatus according to claim 8 further comprising the steps of dispensing a first cleaning solution of an acid-containing solution and a second cleaning solution of deionized water.

10. A two-step method for cleaning a polishing pad in a chemical mechanical polishing apparatus according to claim 8 further comprising the step of dissolving and removing a polishing debris containing a metal oxide.

11. A two-step method for cleaning a polishing pad in a chemical mechanical polishing apparatus according to claim 8 further comprising the step of dissolving and removing a polishing debris containing at least one oxide selected from the group consisting of cuprous oxide and cupric oxide.

12. A two-step method for cleaning a polishing pad in a chemical mechanical polishing apparatus according to claim 8 further comprising the step of dispensing said second cleaning solution from said spray nozzle to neutralize said first cleaning solution.

13. A two-step method for cleaning a polishing pad in a chemical mechanical polishing apparatus according to claim 8 further comprising the step of dispensing said second cleaning solution at a higher flow rate than a rate said first cleaning solution is dispensed.

14. A two-step method for cleaning a polishing pad in a chemical mechanical polishing apparatus according to claim 8 further comprising the step of dispensing said first cleaning solution at a flow rate of at least 200 ml/min.

15. A two-step method for cleaning a polishing pad in a chemical mechanical polishing apparatus according to claim 8 further comprising the step of mounting said cleaning solution spray nozzle on a conditioner arm adjacent to said conditioning pad.

16. An apparatus for chemical mechanical polishing copper on a semiconductor wafer and for removing a polishing debris from said wafer comprising:

a rotating platen having a polishing pad mounted on top, a first liquid dispenser mounted over said polishing pad for dispensing a slurry solution on said polishing pad, a wafer holder for holding a wafer and for pressing an active surface thereof against said polishing pad, a conditioning pad for intimately engaging said polishing pad, at least two different cleaning solutions for dissolving polishing debris on said polishing pad, a second liquid dispenser mounted juxtaposed to said conditioning pad for dispensing sequentially said at least two different cleaning solutions onto said polishing pad, and at least two cleaning solution reservoirs for storing at least two different cleaning solutions for feeding to said second liquid dispenser.

17. An apparatus for chemical mechanical polishing copper on a semiconductor wafer and for removing a polishing debris from said wafer according to claim 11, wherein said at least two different cleaning solutions comprises an acid-containing solution, an ammonium hydroxide-containing solution and deionized water.

18. An apparatus for chemical mechanical polishing copper on a semiconductor wafer and for removing a polishing debris from said wafer according to claim 16, wherein said second liquid dispenser is mounted on a conditioner arm.

19. An apparatus for chemical mechanical polishing copper on a semiconductor wafer and for removing a polishing debris from said wafer according to claim 16 further comprising at least one conduit for feeding said at least two different cleaning solutions from said second liquid dispenser.

20. An apparatus for chemical mechanical polishing copper on a semiconductor wafer and for removing a polishing debris from said wafer according to claim 16 further comprising a three-way valve and a pump for selecting and pumping one of said at least two cleaning solutions to said second liquid dispenser.

* * * * *